US009617644B2

(12) United States Patent
Königshofen et al.

(10) Patent No.: US 9,617,644 B2
(45) Date of Patent: Apr. 11, 2017

(54) METHOD FOR DIRECT METALLIZATION OF NON-CONDUCTIVE SUBSTRATES

(76) Inventors: Andreas Königshofen, Leverkusen (DE); Danica Elbick, Solingen (DE); Markus Dahlhaus, Schermbeck (DE)

( * ) Notice: Subject to any disclaimer, the term of this patent is extended or adjusted under 35 U.S.C. 154(b) by 993 days.

(21) Appl. No.: 13/636,087

(22) PCT Filed: Mar. 21, 2011

(86) PCT No.: PCT/US2011/029194
§ 371 (c)(1),
(2), (4) Date: Feb. 4, 2013

(87) PCT Pub. No.: WO2011/116376
PCT Pub. Date: Sep. 22, 2011

(65) Prior Publication Data

US 2013/0316082 A1 Nov. 28, 2013

(30) Foreign Application Priority Data

Mar. 19, 2010 (DE) ..... 10 2010 012 204

(51) Int. Cl.

| | |
|---|---|
| ***C23C 18/54*** | (2006.01) |
| ***C23C 18/28*** | (2006.01) |
| ***C23C 18/30*** | (2006.01) |
| ***C23C 18/40*** | (2006.01) |
| ***C23C 18/16*** | (2006.01) |
| ***C23C 18/20*** | (2006.01) |
| ***C23C 18/34*** | (2006.01) |
| ***C23C 18/36*** | (2006.01) |
| ***C23C 18/44*** | (2006.01) |
| ***C23C 18/52*** | (2006.01) |
| ***C25D 11/00*** | (2006.01) |

(52) U.S. Cl.
CPC ..... *C23C 18/54* (2013.01); *C23C 18/1651* (2013.01); *C23C 18/1653* (2013.01); *C23C 18/208* (2013.01); *C23C 18/285* (2013.01); *C23C 18/30* (2013.01); *C23C 18/34* (2013.01); *C23C 18/36* (2013.01); *C23C 18/40* (2013.01); *C23C 18/44* (2013.01); *C23C 18/52* (2013.01); *C25D 11/00* (2013.01)

(58) Field of Classification Search
CPC ..... C23C 18/40
See application file for complete search history.

(56) References Cited

U.S. PATENT DOCUMENTS

| | | | | |
|---|---|---|---|---|
| 3,011,920 | A | 12/1961 | Shipley, Jr. | |
| 3,046,159 | A | 7/1962 | Brookshire | |
| 3,615,736 | A | 10/1971 | Stone et al. | |
| 3,870,526 | A | 3/1975 | Pearlstein et al. | |
| 4,209,331 | A * | 6/1980 | Kukanskis | C23C 18/40 106/1.23 |
| 4,265,943 | A | 5/1981 | Goldstein et al. | |
| 4,349,421 | A * | 9/1982 | Khattab | C23C 18/30 205/168 |
| 4,478,883 | A | 10/1984 | Bupp et al. | |
| 4,482,596 | A | 11/1984 | Gulla et al. | |
| 4,565,606 | A | 1/1986 | Cassat | |
| 4,751,106 | A * | 6/1988 | Wilkinson et al. | 427/97.2 |
| 4,814,205 | A | 3/1989 | Arcilesi et al. | |
| 4,895,739 | A | 1/1990 | Bladon | |
| 4,979,988 | A | 12/1990 | Iacovangelo | |
| 5,198,273 | A | 3/1993 | Ando et al. | |
| 5,376,248 | A | 12/1994 | Conrod et al. | |
| 5,454,930 | A | 10/1995 | Miura et al. | |
| 5,484,518 | A | 1/1996 | Goldberg | |
| 5,543,182 | A | 8/1996 | Joshi et al. | |
| 6,193,789 | B1 * | 2/2001 | Honma | C23C 18/40 106/1.23 |
| 6,265,086 | B1 | 7/2001 | Harkness | |
| 6,541,080 | B1 | 4/2003 | Pies | |
| 6,660,071 | B2 | 12/2003 | Yoshida et al. | |
| 6,709,561 | B1 | 3/2004 | Pavlov et al. | |
| 6,712,948 | B1 | 3/2004 | Naruskevicius et al. | |
| 6,855,191 | B2 | 2/2005 | Kato et al. | |
| 6,875,474 | B2 * | 4/2005 | Kohl | C23C 18/40 106/1.18 |
| 7,220,296 | B1 * | 5/2007 | Chowdhury | C23C 18/40 106/1.23 |
| 7,678,183 | B2 | 3/2010 | Murasumi et al. | |
| 2003/0047458 | A1 * | 3/2003 | Begum | H05K 3/188 205/159 |
| 2003/0113576 | A1 | 6/2003 | Chebiam et al. | |
| 2004/0253450 | A1 | 12/2004 | Seita et al. | |
| 2005/0266165 | A1 | 12/2005 | Mobius et al. | |
| 2006/0280872 | A1 | 12/2006 | Königshofen et al. | |
| 2009/0301763 | A1 | 12/2009 | Lin et al. | |
| 2013/0316082 | A1 | 11/2013 | Konigshofen et al. | |

FOREIGN PATENT DOCUMENTS

| | | | |
|---|---|---|---|
| CN | 1974840 | A | 6/2007 |
| GB | 1176051 | A | 1/1970 |
| JP | 02-145771 | * | 6/1990 |
| JP | 2000-144439 | | 5/2000 |
| JP | 2001-152353 | A | 6/2001 |

OTHER PUBLICATIONS

Machine translation of Japan 1001-152353, first published in Japan Jun. 2001, 8 pages.*
International Preliminary Report on Patentability, PCT/US2011/029194, dated Sep. 25, 2012, 9 pages.
Written Opinion, PCT/US2011/029194, dated May 20, 2011, 8 pages.
International Search Report, PCT/US2011/029194, dated May 20, 2011, 7 pages.

* cited by examiner

*Primary Examiner* — Katherine A Bareford
(74) *Attorney, Agent, or Firm* — Carmody Torrance Sandak & Hennessey LLP

(57) ABSTRACT

The present invention relates to a method for direct metallization of non-conductive substrates as well as a conductor solution used in such a method. According to the invention, it is proposed to contact a non-conductive substrate surface after activation by a noble metal colloid-containing activator solution with a conductor solution, which comprises a metal that is reducible by a metal of the activator solution, a complexing agent and a reducing agent.

16 Claims, No Drawings

METHOD FOR DIRECT METALLIZATION OF NON-CONDUCTIVE SUBSTRATES

REFERENCE TO RELATED APPLICATIONS

This application is the U.S. national stage application of International Patent Application No. PCT/US2011/029194, filed Mar. 21, 2011, and claims the benefit of German Application No. 10 2010 012 204.1, filed Mar. 19, 2010, the entire disclosures of which are incorporated herein by reference.

BACKGROUND OF THE INVENTION

The present invention relates to an improved method for direct metallization of non-conductive substrates. Included under the term direct metallization is a method in which a non-conductive substrate surface, such as a plastic surface, is activated by corresponding pretreatment steps to roughen the surface with a noble metal/metal-colloid containing aqueous formulation, whereby noble metal/metal-colloids are deposited on the substrate surface to be metallized. By subsequent treatment of the thus activated substrate surface with a metallic salt solution, which contains a metal cation reducible by an oxidizable metal ion of the colloidal formulation, the oxidizable metal ion of the colloidal formulation is replaced on the substrate surface by the metal of the metallic salt solution and forms a conductive layer on the substrate surface, which can serve as a starting point for subsequent metallization by electroless or electrolytic plating. In particular, a direct metallization process differs from conventional methods for metallizing non-conductive substrates by not treating the activated substrate surface with an accelerator solution and a subsequent chemical deposition of first metal layer, such as a nickel layer. By omitting these additional process steps and the associated economic and environmental advantages, the direct metallization has become an important method in the field of plating on plastics.

Corresponding methods for the direct metallization are known, for example, from EP 1734156 and corresponding US 2006/0280872 or EP 0 538 006 and corresponding U.S. Pat. No. 5,376,248. For example, European Patent Application EP 0 538 006 discloses a method for direction metallization, in which the substrate is activated with an activator solution comprising a palladium-tin colloid and following the activation, is contacted with a post-activator solution, which contains a sufficient amount of metal ions which undergo a disproportionation reaction under the reaction conditions. The treated substrates subsequently can be then electrolytically copper-plated for example in an acid copper electrolyte. EP 1734156 A1 discloses a method for direct metallization, in which likewise a non-conductive substrate is activated after a corresponding pre-treatment with metallic salt containing activator solution and a first conductive layer is formed on the thus activated substrate by means of a suitable metallic salt solution, on which a subsequent metal deposition can take place.

A disadvantage of the methods known from the state of the art is that on the one hand relatively high noble metal/metal-colloid concentrations must be used in the activator solutions, which leads to higher costs based on the associated high noble metal concentration and on the other hand, only certain plastics can be metallized by means of such methods.

Based on this prior art, it is therefore the object of the present invention to provide an improved method for direct metallization of non-conductive substrates, in which on the one hand smaller noble metal concentrations can be used in the activator solution, and on the other hand, a greater number of plastics can be metallized reliably.

This problem is solved by a method according to the novel method of the invention, preferably using a novel alkaline conductor solution, as described herein. Further refinements of the method and the alkaline conductor solution can be found in the following description and the dependent claims.

SUMMARY OF THE INVENTION

The present invention comprises novel conductor solutions and a methods for using the solutions in direct metallization of a non-conductive substrate.

Briefly, the invention is direct to an alkaline conductor solution comprising a reducible cation of at least one metal selected from the group consisting of copper, silver gold, palladium, platinum, and bismuth, a complexing agent which is suitable to complex the reducible cation, at least one Group IA or Group II metal ion of the group consisting of lithium, sodium, potassium, beryllium, rubidium, and cesium, a counteranion selected from the group consisting of fluoride, chloride, bromide, iodide, nitrate, sulfate and combinations thereof, and a reducing agent other than formaldehyde. The ratio of the sum of the molar concentrations of the aforesaid counteranion(s) to the sum of the molar concentration of all reducing agents for the reducible metal cation in the conductor solution is between about 0.70 and about 50, preferably between about 2 and about 30, more preferably between about 5 and about 20, and the ratio of the total concentration of reducible metal cations to nickel ions is at least about 10, preferably at least about 100, most preferably at least about 1000. Nickel ions are most preferably substantially absent from the conductor solution.

The invention is further directed to an alkaline conductor solution for use in a direct metallization method, comprising a reducible cation of at least one metal selected from the group consisting of copper, silver gold, palladium, platinum, and bismuth, a complexing agent which is suitable to complex the reducible cation, at least one Group IA or Group II metal ion of the group consisting of lithium, sodium, potassium, beryllium, rubidium, and cesium, a counteranion selected from the group consisting of fluoride, chloride, bromide, iodide, nitrate, sulfate and combinations thereof, and a reducing agent other than formaldehyde. The ratio of the sum of the molar concentration(s) of the aforesaid counteranion(s) to the sum the molar concentration(s) of the Group IA and Group II metal ions in the conductor solution is at least about 0.2, preferably at least about 0.3, more preferably between about 0.2 and about 1.0, or between about 0.3 and about 0.8.

The invention is further directed to an alkaline conductor solution for use in a direct metallization method, comprising a reducible cation of at least one metal selected from the group consisting of copper, silver gold, palladium, platinum, and bismuth, a complexing agent which is suitable to complex the reducible cation, at least one Group IA or Group II metal ion of the group consisting of lithium, sodium, potassium, beryllium, rubidium, and cesium, a counteranion selected from the group consisting of fluoride, chloride, bromide, iodide, nitrate, sulfate and combinations thereof, and a reducing agent other than formaldehyde. The ratio of the sum of the molar concentrations of the aforesaid counteranion(s) to the sum the molar concentration(s) of the reducible metal cation(s) in the conductor solution is at least about 5, and the ratio of the total concentration of reducible metal cations to nickel ions is at least about 10, preferably at least about 100, most preferably at least about 1000. Nickel ions are most preferably substantially absent from the conductor solution.

The invention is further directed to an alkaline conductor solution for use in a direct metallization method, comprising a reducible cation of at least one metal selected from the group consisting of copper, silver gold, palladium, platinum, and bismuth, a complexing agent which is suitable to complex said reducible cation, lithium ion, a counteranion selected from the group consisting of fluoride, chloride, bromide, iodide, nitrate, sulfate and combinations thereof, and a reducing agent other than formaldehyde. The ratio of the concentration of reducing agent to the concentration of reducible metal cations is at least about 1.0, preferably at least about 2, more preferably at least about 3, and most preferably between about 3 and about 8.

The invention is further directed to a method for direct metallization of a non-conductive substrate. According to the method, the substrate is contacted with an aqueous metal-containing activator formulation comprising a noble metal/metal-colloid. The noble metal/metal-colloid comprises a colloidal noble metal selected from the group consisting of gold, silver, platinum and palladium and oxidizable ions of a metal selected from the group consisting of iron, tin, lead, cobalt, and germanium. Contact with the activator formulation deposits colloidal noble metal on the substrate and activates the substrate for deposition of another metal. The activated substrate is contacted with a conductor solution comprising a cation of another metal that is reducible by a metal ion of the activator formulation. At the time of initial contact with the activated substrate, the conductor solution may have the composition of any and/or all of the conductor solutions summarized above. The reducible metal cation is reduced by reaction with the oxidizable metal ion and by reaction with the reducing agent as catalyzed by the noble metal, thereby depositing the another metal on said substrate.

The invention is still further directed to a process for direct metallization of a non-conductive substrate, in which the substrate is contacted with an aqueous metal-containing activator formulation as described above. The activated substrate is contacted with a conductor solution comprising cupric ion, a complexing agent, and a plurality of reducing agents other than formaldehyde. The conductor solution is substantially free of formaldehyde and any promoter of the electroless deposition of copper by reduction of cupric ion. Copper or another reducible metal cation is electrolessly and/or galvanically plated copper onto the substrate.

DESCRIPTION OF THE PREFERRED EMBODIMENTS

According to the present invention, therefore, a direct metallization of a non-conductive substrate is proposed, at least comprising the following steps:

- contacting the substrate with a metal-containing activator formulation;
- contacting the substrate that was contacted with the activator solution with a conductor solution;
- electrolessly or galvanically plating the substrate treated with the conductor solution with a metal, whereby the aqueous activator formulation comprises a dispersion comprising at least one colloidal metal of the group consisting of gold, silver, platinum or palladium as a noble metal/metal colloid that further comprises an oxidizable metal ion of the group consisting of iron, tin, lead, cobalt, germanium, and the conductor solution is a metallic salt solution which comprises a metal cation that is reducible by a metal ion of the activator solution, as well as a complexing agent, which method is characterized by the further presence of a reducing agent in the conductor solution.

In accordance with the invention, the conductor solution further comprises a Group IA or Group II metal ion and a counteranion comprising fluoride, chloride, bromide, iodide, nitrate or sulfate. The presence of such combination of ionic components functions in the process to inhibit deposit of mineral salts on equipment, and further contributes to the surface conductivity of the metal deposit.

It has been shown that the addition of a suitable reducing agent to a conductor solution in a method for direct metallization leads to a significant increase in the concentration of the metal of the conductor solution that is reducible by a metal of the activator solution on the substrate surface. Thus, for example, it was surprisingly shown that the addition of a suitable reducing agent to a copper-containing conductor solution lead to increased copper concentration at a factor of >100 higher copper concentration per area on the substrate, which was previously activated with a palladium-tin colloid-containing activator, without the typical continuing deposit of copper on copper which characterizes plating from conventional electroless copper plating baths. This significant increase in copper concentration on the substrate surface leads to a significant reduction in the electrical resistance of the surface and an increase in deposition rate during the subsequent metallization. This permits a considerable reduction of the precious metal concentration allowed in the activator to the order of 50% compared to the methods known until now from the state of the art for the same or significantly better deposition results.

In a preferred embodiment of the method, the metal reducible by a metal of the aqueous activator dispersion is deposited on the substrate surface in a molar ratio to the noble metal of 5:1 to 400:1, preferably 20:1 to 200:1. Prior to deposition of copper, silver, gold, palladium, platinum, or bismuth from the conductor solution, the concentration of the colloidal noble metal on the substrate is preferably not greater than about 100 $mg/m^2$, preferably, not greater than about 60 $mg/m^2$, most preferably, not greater than 40 $mg/m^2$.

Suitable reducing agents are those which are stable under the alkaline conditions of the conductor solution, and whose reduction potential and/or concentration is chosen such that in the conductor solution, mainly a deposition of the metal contained in the conductor solution on the previously applied noble metal occurs and simultaneously, a deposition of metal on metal, which typically for electroless electrolytes, is essentially omitted. Particularly suitable are compounds of the group consisting of hypophosphites, aminoboranes, hydroxymethylsulfonates, hydroxylammonium sulfates, bisulfites and thiosulfates. It was shown that in the inventive method, despite addition of such reducing agents, the present invention continues to be a method for direct metallization rather than an autocatalyzed electroless deposition process, as in other areas of the state of the art. It has been shown that no deposition of thicker metal layers occurs in the substrate treatment step with the conductor solution, but that the formation of the conductive layer stops immediately or shortly after the surface is coated accordingly. In plating of Cu onto an activated substrate from a conductor solution comprising $CuCl_2$ or $CuSO_4$, the rate of Cu deposition reaches a maximum of typically at least about 400 $mg/m^2$/minute, more typically at least about 450 $mg/m^2$/minute, upon contacting the activated substrate with the conductor solution. Deposition rates of greater than 500 $mg/m^2$/minute are achievable and preferred. However, in the direct metallization process of the invention, unlike conventional electroless plating, the maximum plating rate does not continue for any substantial period of time. On the contrary, the plating rate ordinarily declines rapidly as a monolayer of copper becomes deposited on the substrate. For example, after the activated substrate is contacted with the conductor solution, the plating rate very quickly reaches a maximum, then rapidly and progressively declines. For example, within eight minutes of the time that the maximum plating rate is achieved, the rate typically drops to a value that is not greater than 2.5%, more typically no more than 2.2%, and ideally not more than 2.0% of the maximum rate.

Thus, the process of the invention differs fundamentally from conventional autocatalytic electroless plating in which continued deposition of copper on copper is autocatalyzed in the presence of a functional concentration of a promoter comprising an oxy anion such as alkali and alkaline earth carbonates, alkali and alkaline earth borates, alkali orthophosphates, alkali metaphosphates, ethylene carbonate, propylene carbonate, alkali metal fluoroborates, and alkali metal alkoxides. Where a functional concentration of a promoter is present, the deposited copper catalyzes the reduction of additional copper from the plating solution, copper deposits on copper, and the plating process proceeds indefinitely at an undiminished pace.

In contrast, the direct deposition of metal according to the process of the invention proceeds only until a very thin layer of copper or other plating metal such as silver, gold, bismuth, palladium or platinum has accumulated on the substrate. Although the exact thickness of the metal deposit has not been measured, it is understood to be substantially a monolayer as, for example, is the case in pure displacement plating where deposit of the more noble oxidizing metal, e.g., copper, occludes the surface of the less noble reducing metal, e.g., tin, or of a noble metal colloid to which stannous ions are co-ordinated, so that no further reduction and deposit of copper can occur at any location where copper metal has deposited.

Unlike the plating solution used in conventional displacement plating, the conductor solution used in the process of the invention contains a reducing agent which functions in the presence of a noble metal catalyst to reduce the reducible metal cation such as cupric ion and deposit of the corresponding elemental metal such as copper. However, in contrast to plating bath used in conventional electroless plating, the plating bath used in the process of the invention is substantially free of a conventional promoter. A minor fraction of carbonate or bicarbonate may be present due to absorption of $CO_2$ from the atmosphere into the alkaline conductor solution during the plating step. However, the quantity absorbed does not raise the carbonate or bicarbonate concentration in the conductor solution to a level which promotes autocatalytic electroless plating of the copper, silver, gold, bismuth, palladium or platinum by reduction of their corresponding cations from the solution. Typically, the sum of the concentrations of carbonate and bicarbonate in the conductor solution, from adventitious sources or otherwise, does not exceed about 1%, more preferably not more than about 0.2% by weight.

Although carbonate and bicarbonate do not function as promoters in the process of the invention, they have been nominated as promoters in the prior art. Preferably, the conductor solution is also free of any functional concentration of a promoter other than carbonate or bicarbonate. For example, the concentration in the conductor solution of promoter anions other than carbonate or bicarbonate is preferably not greater than about 0.5%, more preferably not greater than 0.1%. The process also does not require the intervening treatment of the activated substrate with an accelerator prior to the direct plating step or the deposit of a priming layer comprising nickel or other third metal.

Unlike the electroless plating baths described in references such as Gulla et al. U.S. Pat. No. 4,482,596, the conductor solution used in the plating step of the process need not contain a second reducible metal ion. In some instances a second metal may be useful, or necessary where the object is deposition of an alloy. But in certain embodiments it may be desirable to minimize or avoid the presence of a second metal in the deposit, as for example where the object is deposition of copper to enhance the conductivity of the substrate, since alloying metals generally increase the resistivity of a copper deposit. Thus, for example, where copper is directly plated onto the substrate from the conductor solution, it is not necessary for the solution to contain either Ni or Co ions. In fact, it is preferred that the concentration of the sum of nickel and cobalt ions be not greater than 0.1% by weight. More generally, it is preferred that the ratio of the total concentration of reducible metal cations to nickel ions is at least about 10, preferably at least about 100, nickel ions being most preferably substantially absent from the conductor solution, especially where the reducible metal ion consists essentially of copper. In direct copper plating, the ratio of cupric ions to the sum of Ni and cobalt ions is preferably at least about 20, more preferably at least 100, most preferably at least about 1000.

When a copper deposit is formed in accordance with the process of the invention, any significant presence of phosphorus in the copper deposit can be avoided. Preferably, the phosphorus content of a copper deposit is not greater than about 3% by weight.

It is believed that, in the process of the invention, deposition of metal on the substrate can proceed simultaneously by two separate mechanisms so long as the colloidal noble metal is available on which the copper, silver, gold, bismuth, palladium or platinum can deposit. The reducible metal cation of the conductor solution, e.g., cupric ion, is reduced by reaction with the oxidizable metal ion of the activator solution, e.g., stannous ion, in a proper displacement reaction; but the exposed colloidal noble metal simultaneously catalyzes the electroless reduction of the reducible metal cation to increase the overall rate of metal deposition compared to the rate achieved by the displacement redox reaction alone. It is further understood that, in the absence of a functional concentration of an electroless plating promoter, the parallel electroless deposition reaction terminates along with the displacement reaction when the colloidal noble metal catalyst is fully occluded by deposited metal.

A further indication that the inventive method is a method for direction metallization is that in a subsequent electrolytic deposition of a metal on a substrate surface that has been treated accordingly, a deposition begins on the electrical contact points of the substrate and from there, migrates over the surface, as is known from direct metallization method with subsequent electrolytic plating according to the state of the art.

Although the copper, silver, gold, palladium, or platinum deposited from the conductor solution forms only a monolayer on the substrate activated by the noble metal/metal-colloid, it has been found that the density of the coating is nonetheless substantially greater than the density of the coating obtained by conventional displacement plating. For example, the density of the deposited metal is generally at least about 500 mg/m$^2$, more typically at least about 800 mg/m$^2$, about 1000 mg/m$^2$, or even greater than about 1200 mg/m$^2$ based on the geometric area of the activated substrate contacted with the conductor solution. The "geometric area" of the substrate as used herein is the area of the surface defined by the macro dimensions of the substrate, without consideration of the specific surface area generated by the micro-roughness or porosity of the surface. The density of the direct metal deposit is typically as much or more than 100× greater than the deposit density achieved by conventional displacement plating.

Consequently, the surface resistance of the copper or other metal deposit on the substrate is typically not greater than about 2000Ω, normally not greater than about 1600Ω, and preferably not greater than about 1000Ω, over a 5 cm distance along the surface of the metal deposit. In embodiments of the invention wherein two or more different reducing agents are used, such as, for example, the combination of an alkali metal phosphite and a hydroxyalkane sulfonic acid salt, the surface resistivity may be as low as 500Ω or even lower over a 5 cm distance.

Without being committed to a particular theory, it is believed that increased density of the deposit may result in part from the fact that the noble metal colloid presents additional surface area for deposition of metal while not fully covering the substrate. Thus, in the presence of the reducing agent contained in the conductor solution, the noble metal may catalyze metal deposition on proximate plastic surfaces that are not covered by the catalyst. Consequent lateral growth of the deposit may contribute to the density of the deposit.

The oxidizable metal ions of the activating colloids, e.g., $Sn^{++}$ ions in the case of copper deposition, are understood to be present in ligands that are co-ordinated to the colloidal noble metal, e.g., Pd. Thus, even if the noble metal is occluded by metal deposited through catalyzed reaction of the reducible metal ion, e.g., copper, with the reducing agent, the oxidizable metal ion ligands may yet extend into the solution to effect further deposition via direct metal ion to metal ion displacement reaction. Such phenomenon may further add to the density of the deposit. However, it appears that the larger share of metal deposition may be attributable to the noble-metal catalyzed reaction of the reducible metal cation with the reducing agent contained in the conductor solution. Thus, in process as conducted according to Example 1 hereinbelow, about 20-60 mg/m$^2$ copper is estimated to have deposited by the displacement reaction, $Cu^{++}+Sn^{++}\rightarrow Cu^0+Sn^{++++}$, whereas 1400-2000 mg/m$^2$ is estimated to have deposited by Pd catalyzed reaction of cupric ion with the reducing agent, $Cu^{++}+2e^-\rightarrow Cu^0$.

While the structure of the noble metal/metal-colloid may vary with the respective metals involved, the counteranions present, etc, in some embodiments wherein the noble metal comprises palladium and the oxidizable metal ion comprises Sn(II), it is understood that the colloid may have the structure described by Olaf Holderer,[‡‡] Thierry Epicier,[*†] Claude Esnouf,[‡] and Gilbert Fuchs, *J. Phys. Chem. B,* 2003, 107 (8), pp 1723-1726). This article advises that "Palladium-tin nanocolloids have been analyzed with high-resolution transmission electron microscopy (HRTEM) and electron energy-loss spectroscopy (EELS). The composition of individual colloids with a diameter of 2-5 nm has been deduced. It has been established that the colloids consist of a core of a $Pd_xSn_{1-x}$ alloy, with x ranging from 0.6 to 1. From the numerical comparison of experimental EELS line scans with reconstructed ones from a model colloid, it has been possible to evidence a slight Sn surface enrichment equivalent to a submonolayer of pure Sn on the surface of the colloid."

According to the present invention, the reducing agent can be present in the conductor solution in a concentration between 0.1 mmol/l and 0.25 mol/l, preferably 0.006 mol/l and 0.170 mol/l, even more preferably between 0.01 mol/l and 0.1 mol/l, and particularly preferably between 0.02 mol/l and 0.09 mol/l. It has been shown in this context that a further increase of the reducing agent concentration in the conductor solution has no effect on the activation of the substrate or deposition of metal thereon, and in particular, that no further improvement of the activation or metal deposition can be observed. In addition, with too high of a concentration of the reducing agent, under certain conditions, an unwanted roughness on the substrate surface can occur, due to a rate of metal deposition that was too fast.

However, it is particularly preferred that the concentration of reducing agent be at least about 0.04 mol/liter, and that the ratio of reducing agent to reducible metal cation be at least about 1.0, preferably at least about 2, e.g., between about 2 and about 15, more preferably at least about 3, and most preferably between about 3 and about 8. These concentrations, and in particularly these ratios of reducing agent to copper metal ion help assure that the simultaneous displacement reaction and noble metal catalyzed reduction of the reducible metal cation achieve the significantly enhanced surface density of copper, or other metal deposit as described herein, without the negative consequences of ongoing autocatalytic electroless deposition. The higher surface density translates into higher surface conductivity, thus facilitating the subsequent electrolytic or electroless deposition process.

In a preferred embodiment of the method according to the invention, the activator solution is free of metals, such as, for example, Cu(I), which under the conditions of the conductor solution, are subject to a disproportionation reaction. Preferably, the activator solution is entirely free from copper and/or nickel ions in such an embodiment. The presence of such metals in the activator solution can lead to uncontrolled deposition reactions, which in turn can lead to a non-uniform deposition result in the final plating of the substrate surface.

In a preferred embodiment of the method of the present invention, a Group IA or Group II metal ion consisting of lithium, sodium, potassium, beryllium, rubidium, or cesium is added to the conductor solution, preferably as a salt of a counter-anion selected from the group consisting of fluorides, chlorides, iodides, bromide, nitrates, sulfates, or mixes of these. The addition of a Group IA metal ion or beryllium ion leads to an improvement of the deposit results, in particular to an improved exchange of the oxidizable metal ions of the colloidal activator with the reducible metal ions of the conductor solution. In this manner, a faster draw together of the substrate surface in the subsequent plating can be achieved. Draw together is to be understood as the complete covering of the substrate surface with the deposition metal. Thus, an enhancement in surface conductivity of the metal deposit is provided by incorporating $Li^+$, $Na^+$, $K^+$, $Be^{++}$, $Rb^+$ or $Cs^+$ ions.

The addition of a metal of the previously named group as a salt wherein the counter-anion is of the group consisting of fluorides, chlorides, iodides, bromides, nitrates, sulfates has shown the advantage that the formation of deposits ("incrustation") in the coating assembly can be reduced, whereby the maintenance of the assembly is reduced.

In particular, it is preferred that the molar ratio of the sum of the concentrations of all the aforesaid counteranions to the sum of the concentrations of all Group IA and Group II metal ions be at least about 0.2, e.g., between about 0.2 and about 1.0, more preferably at least about 0.3, typically between about 0.3 and about 0.8.

It is further preferred that that the molar ratio of the sum of the concentrations of such counteranions to the sum of the concentrations of all reducing agents for the reducible metal cation be between about 0.70 and about 50, more preferably between about 2 and about 40, or between about 2 and about 30, between about 4 and about 40, between about 4 and about 30, most preferably between about 5 and about 20.

It is also preferred that the ratio of the sum of the concentration(s) of the aforesaid cations to the concentration of reducible metal cation(s) is at least about 5, preferably at least about 40.

In a further embodiment of the method according to the present invention, at least two different reducing agents are added to the conductor solution. It has been shown that the addition of at least two different reducing agents lead to a further increase in the concentration per area of the metal reducible by a metal of the activator solution on the substrate surface. This allows the electrical resistance of the substrate surface to be reduced even further. The total concentration of the reducing agent here is preferably in the above-mentioned range. In the direct plating of copper, it has been observed that a particularly dense low resistivity deposit is obtained where the conductor solution comprises a combination comprising an alkali metal hypophosphite, preferably in a concentration between about 50 and about 200 mmoles/liter, and a hydroxyalkane sulfonic acid, preferably in a concentration between about 3 and about 60 mmoles/liter, more preferably between about 5 and about 20 mmoles/liter.

Preferred combinations of reducing agents and complexing agents comprise, for example: (a) between about 0.1 and about 0.3 mol/l tartaric acid and between about 50 and about 200 mmoles/liter alkali metal hypophosphite; (b) between about 0.1 and about 0.3 mol/l tartaric acid, between about 50 and about 200 mmol/l alkali metal hypophosphite and between 3 and about 60, preferably between about 5 and about 20 mmol/l, alkali metal hydroxylmethylsulfonate; (c) between about 0.1 and about 0.3 mol/l glycolic acid and between about 50 and about 200 mmol/l alkali metal hypophosphite (d) between about 20 and about 200 g/l tartaric acid, between about 1 g/l and about 50 g/l, preferably between about 2 and about 20 g/l, alkali metal hypophosphite, and between about 0.5 and about 20 g/l alkali metal hydroxylmethyl sulfonate; and (e) between about 0.1 and about 0.3 mol/l tartaric acid and between about 2 and about 50 g/l, preferably between about 3 and about 30 g/l, alkali metal hypophosphite. The examples below illustrate specific combinations that have been shown to have a material effect in reducing surface resistivity, including (i) tartaric acid (0.2 mol/l)+sodium-hypophosphite (80 mmol/l); (ii) tartaric Acid (0.2 mol/l)+sodium-hypophosphite (80 mmol/l)+sodium hydroxylmethylsulfonate (8 mmol/l); and (iii) glycolic acid (0.2 mol/l)+sodium-hypophosphite (80 mmol/l), each demonstrated in Example 1. Other combinations include: (iv) tartaric acid (65 g/l)+sodium hypophosphite (5 g/l)+sodium-hydroxyl-methyl-sulfonate (1 g/l), demonstrated in Example 3; and: (v) tartaric acid (0.2 mol/l)+sodium hypophosphite (10 g/l), demonstrated in Example 4.

Surprisingly, it has been found that with the use of a noble metal/metal-colloid in the aqueous activator dispersion according to the method according to the present invention, also the concentration of colloidal metal can be significantly reduced. When using a palladium/tin-colloid-containing activator formulation, the concentration of the colloidal metal could be reduced to a third of the conventional colloidal metal concentration. This results in an improvement of the deposition results in addition to direct economic benefits derived by the reduced use of materials, since based on the reduced tin concentration, the formation of cassiterite can be significantly reduced, which can otherwise lead to unwanted roughness of the deposited metal layer.

The method of the present invention has been found suitable for the direct metallization of a variety of plastics. In particular, the invention is suitable for the direct metallization of acrylonitrile/butadiene/styrene (ABS), polycarbonate (PC) and their blends as well as for the metallization of MIDs (Molded Interconnecting Devices) and synthetic resins, used in printed circuit board technology applications. For example, the method of the invention is effective for applying copper or another metal deposit on a substrate that comprises a blend of acrylonitrile-butadiene-styrene resin and at least 10 wt. %, 20 wt. %, 30 wt. %, 40 wt. %, 50 wt. % or 60 wt. % of another resin, most preferably a substrate that comprises a blend of ABS and least 10 wt. %, 20 wt. %, 30 wt. %, 40 wt. %, 50 wt. % or 60 wt. % polycarbonate resin.

More particularly, the process of the invention provides a higher density deposit of copper or other deposited metal on the resin surface without the drawbacks of the ongoing autocatalytic process. The higher copper content results in a much better conductivity and allows plating bigger parts including parts comprising blends of ABS with PC and other plastics. Thus, the process of the invention overcomes the limitation of the existing direct metallization processes to plate only ABS with good results.

In addition, with the invention, an alkaline conductor solution for use in a direct metallization method is provided, comprising at least one metal from the group consisting of copper, silver, gold, palladium, platinum and bismuth, a complexing agent, which is suitable to complex a metal of the aforementioned group, and comprising at least one Group IA or Group II metal from the group consisting of lithium, sodium, potassium, beryllium, rubidium and cesium. The conductor solution is further characterized by the presence of a reducing agent.

Conductor solutions in the meaning of the present invention are solutions which are used in a direct metallization process after the activation of a non-conductive substrate surface by means of an activator solution to form an adequate electrical conductivity for subsequent metallization by electrolytic or electroless plating.

Preferably, the conductor solution according to the present invention comprises as a reducing agent, most preferably a reducing agent other than formaldehyde. The reducing agent preferably comprises at least one compound from the group consisting of hypophosphites, aminoboranes, hydroxymethylsulfonates, hydroxylammonium sulfates, bisulfites and thiosulfates. It has been shown that these particular aforementioned reducing agents under the alkaline conditions of the conductor solution are stable and do not lead to the formation of unwanted degradation or by-products.

Preferably, the conductor solution is substantially free of formaldehyde, e.g., a formaldehyde content of greater than 0.005 wt. % is preferably avoided.

The reducing agent may be present in the conductor solution according to the present invention in a concentration of between 0.1 mmol/l and 0.25 mol/l, preferably between 0.006 mol/l and 0.170 mol/l, more preferably from 0.01 mol/l and 0.1 mol/l, and more preferably from 0.02 mol/l and 0.09 mol/l.

In a preferred embodiment of the invention, at least two different reducing agents are added to the conductor solution. In particular, the conductor solution in such a preferred embodiment comprises a combination of at least two of the aforementioned reducing agents. It has been found, surprisingly, that a combination consisting of at least two reducing agents leads to an increase of the concentration of the metal of group consisting of copper, silver, gold, palladium, platinum and bismuth on the substrate surface. By this, the conductivity of the surface can be increased and its electrical resistance can be reduced.

In a preferred embodiment of the invention, the metal of the group consisting of lithium, sodium, potassium, beryllium, rubidium or cesium is included in the inventive conductor solution in a concentration of between 0.1 mol/l and 3 mol/l, preferably between 0.5 mol/l and 2 mol/l. In this case, the addition of the metal leads to an improvement of the deposition, in particular to a more uniform formation of a conductive layer on the substrate surface. This enables more uniform metallization in the subsequent metallization step.

Given the absence of any functional concentration of either a promoter or formaldehyde from the conductor solution, and regardless of whether it contains a single reducing agent or plural reducing agents, the solution is highly stable, i.e., resistant to reduction or precipitation of the reducible metal cation unless the solution is in contact with a noble metal catalyst for the redox reaction.

In a preferred embodiment, the metal of the group consisting of lithium, sodium, potassium, beryllium, rubidium and cesium is present in the alkaline conductor solution as a salt, preferably as fluoride, chloride, iodide, bromide, nitrate or sulfate, or a mixture of such salts. It has been shown that the addition of the metals in the form of these salts can reduce the formation of deposits in the coating assembly, thus lowering the maintenance of the assemblies. In a particularly preferred embodiment of the conductor solution, lithium chloride is added. The term "metal" is meant in this context as a source of metal ions in the solution so that it lies within the scope of the invention that such metals are present in ionic form in the solutions.

In a preferred embodiment of the invention, the conductor solution comprises at least two different metals from the group consisting of lithium, sodium, potassium, beryllium, rubidium and cesium. Preferably one metal can be added as a hydroxide and serves as a hydroxide ion source to adjust the alkalinity of the conductor solution, while the other metal is added as a halide, nitrate or sulfate. Particularly preferably, sodium hydroxide and lithium chloride is added to the conductor solution.

In addition, the inventive alkaline conductor solution in a preferred embodiment comprises as a complexing agent a compound from the group consisting of tartaric acid, acetic acid, ethylene-diamine-tetra-acetic acid (EDTA), hydantoin, lactic acid, oxalic acid, salicylic acid, citric acid, glycolic acid, salts or derivatives. In particular, the conductor solution of the present invention can comprise salts of the compounds mentioned above, such as potassium sodium tartrate, sodium glycolate or the like. In one embodiment of the invention, the conductor solution comprises at least two different complexing agents each of which comprises a compound of the aforementioned groups, including salts and derivatives.

The concentration of the complexing agent or combination of all complexing agents in the inventive conductor solution is preferably in a range between 0.1 mmol/l and 1.0 mol/l, more preferably between 0.15 mol/l and 0.3 mol/l. It has been shown that such a complexing agent concentration can reliably prevent the precipitation of the metal to be reduced by a metal of the activator solution, whereby negative effects on the deposition results can be avoided.

The copper, silver, gold, palladium, platinum and bismuth ion that is reducible by a metal ion of the activator formulation may be included in the conductor solution in a concentration between 0.0015 mol/l and 0.15 mol/l, preferably between 0.015 mol/l and 0.315 mol/l. It has been shown that in the indicated concentration range, good conductivity values of the treated substrate surface can be provided.

In a further preferred embodiment of the conductor solution, it has a free alkalinity, i.e., a free hydroxyl ion concentration, between 0.1 mol/l to 3 mol/l. By means of alkalinity in the above noted range, it can be ensured advantageously that colloidal metal oxide actually provided on the substrate surface can be reliably replaced, which could otherwise lead to a poorer deposition result. For setting an appropriate alkalinity, the conductor solution can comprise hydroxide ion sources such as sodium hydroxide, potassium hydroxide, barium hydroxide or lithium hydroxide.

In addition to the aforementioned ingredients, the inventive conductor solution can comprise other ingredients such as stabilizers, wetting agents or other auxiliaries.

As explained above, the conductor solution of the invention is preferably substantially free of a conventional promoter. A minor fraction of carbonate or bicarbonate may be present due to absorption of $CO_2$ from the atmosphere into the alkaline conductor solution during the plating step. However, as further explained above, the quantity of carbon dioxide absorbed does not raise the carbonate or bicarbonate concentration in the conductor solution to a level which promotes autocatalytic electroless plating of the metal from the reducible cations contained in the conductor solution. Typically, the sum of the concentrations of carbonate and bicarbonate in the conductor solution, from adventitious sources or otherwise, does not exceed about 1%, more preferably not more than about 0.2% by weight.

As further discussed above, the concentration in the conductor solution of promoter anions other than carbonate or bicarbonate is preferably not greater than about 0.5%, more preferably not greater than 0.1%. Most preferably, the solution is entirely free of all promoters other than adventititous carbonate or bicarbonate generated by $CO_2$ absorption.

As further discussed above, the conductor solution used in the plating step of the process need not contain a second reducible metal ion unless the object is to deposit an alloy. More particularly, where the conductor solution is used for direct plating of Cu, it is not necessary for the solution to contain either Ni or Co ions. In fact, it is preferred that the concentration of the sum of nickel and cobalt ions be not greater than 0.1% by weight.

In a preferred method for the preparation of the conductor solution of the invention, the salt of copper or other reducible cation is first combined with the complexing agent in an aqueous medium. Thereafter, a source of Group IA and/or Group II metal ions is added to the aqueous medium, together with a source of the counteranion, i.e., fluoride, chloride, bromide, nitrate or sulfate. Preferably the Group IA and/or Group II metal ion is added as a salt of the counteranion. The reducing agent is preferably the last component introduced into the medium.

A preferred Group IA metal ion for inclusion in the conductor solution is lithium, while a preferred counteranion is chloride. Most preferably, these are added in the form of the LiCl salt. If another Group IA and/or Group II metal ion is added, it is also preferably added as the salt of the counteranion, e.g., as NaCl, NaBr, LiBr, KI, etc.

The invention is described in detail below with reference to examples, without limiting the inventive concept to the examples.

Example 1

An ABS plastic substrate called Novodor P2MC was etched for 7 minutes at 68° C. in a conventional chromium-chromic etch with 300 g/l of chromic acid and 400 g/l sulfuric acid and then activated with a palladium-tin colloid-containing aqueous-activator dispersion for 4 minutes at 40° C. Here, the amount of palladium in the activator was 120 mg/l. The amount of Sn(II) in this case was 15 g/l at a concentration of hydrochloric acid (37%) of 300 ml/l. The thus-activated substrate was then treated for 4 minutes at 55° C. with a conductor solution, which in addition to 1 mol/l NaOH, 0.6 mol/l LiCl and 16 mmol/l Cu(II)$SO_4$ had the following components reproduced in the following Table 1. The experiments A and D served as the comparison experiments, in which no reducing agent was added to the conductor solution. Subsequently, the copper deposited on the substrate surface concentration was determined.

TABLE 1

| | Experiment | | | | |
|---|---|---|---|---|---|
| | A | B | C | D | E |
| Complexing Agent | Tartaric Acid 0.2 mol/l | Tartaric Acid 0.2 mol/l | Tartaric Acid 0.2 mol/l | Glycolic Acid 0.2 mol/l | Glycolic Acid 0.2 mol/l |
| Sodium-hypophosphite | — | 80 mmol/l | 80 mmol/l | — | 80 mmol/l |
| Sodium hydroxyl-methylsulfonate | — | — | 8 mmol/l | — | — |
| Surface resistance in 5 cm distance | 12000 Ω | 7000 Ω | 1500 Ω | 17000 Ω | 8000 Ω |
| Cu in mg/$m^2$ | 21 | 1840 | 2020 | 57 | 1430 |
| Pd in mg/$m^2$ | 53 | 51 | 48 | 53 | 46 |
| Sn in mg/$m^2$ | 32 | 28 | 31 | 30 | 34 |
| Weight ratio Cu:PD CU | 0.4:1 | 36:1 | 42:1 | 1:1 | 31:1 |
| Complete covering of 1 $dm^2$ ABS with 3 A/$dm^2$ in acid copper electrolyte | 140 sec | 80 sec | 65 sec | 130 sec | 90 sec |

As Table 1 shows, the addition of a reducing agent to a conductor solution led to a significant increase of the copper concentration on the substrate surface and a significant reduction of the surface resistance. The ratio of copper to palladium on the surface of the substrate treated according to the present invention could be increased by the addition of a reducing agent to the conductor solution by a factor >35 in favor of the copper. In particular, the addition does not lead to a significant change in the tin and palladium concentration on the substrate surface, however. In the subsequent electrolytic copper plating of the substrate in an acid copper electrolyte, a significantly higher rate of deposition was shown with the substrates that were treated with a conductor solution containing a reducing agent. Surprisingly, the substrate surfaces treated with a conductor solution containing a reducing agent shows a distinct purple color. Without being bound to this theory, it is assumed that this purple color is caused by a copper monolayer on the substrate surface.

Example 2

An ABS plastic substrate was pretreated as in Example 1, except that, in the activation dispersion, the concentration of palladium was lowered by ⅓ compared to the concentration in Example 1, i.e., to 80 mg/L. The activated substrate was treated with a conductor solution according to Experiment C of Example 1, and then copper plated in an acid copper electrolyte. In the deposition conditions provided in Table 1, a complete coverage of a 1 $dm^2$ test surface with adherent bright copper layer was obtained within 70 seconds. The amounts of metal deposited on the substrate surface were 27 mg/$m^2$ Pd, 25 mg/$m^2$ Sn, and 1600 mg/$m^2$ Cu. This corresponds to a weight ratio of copper to palladium of 59:1 and a molar ratio of 100:1. The surface resistance was 4000Ω over a 5 cm distance. It was thus shown that, by the inventive addition of a reducing agent to the conductor solution, despite significant reduction of the Pd concentration in the activator solution, a 50% higher deposition rate can be achieved.

The experiment was repeated with a PC/ABS plastic substrate called Bayblend T65 PG, wherein the palladium concentration in the activator was lowered by ⅔ compared to the concentration required when using a conventional conductor solution, i.e., to 40 mg/L. Also in this case, a complete coverage of a test surface with an adherent layer of copper was obtained within a more than 50% shorter coating time. The deposited amount of metal on the substrate surface amounted in this case to 29 mg/$m^2$ Pd, 24 mg/$m^2$ Sn, and 1200 mg/$m^2$ Cu. This corresponds to a weight ratio of copper to palladium of 41:1 and a molar ratio of 69:1.

Example 3

A circuit board panel for inner layers and multi layers of 60×45 cm size was treated to full-scale copper plating in a vertical application for 4 minutes at a temperature of 42° C. in a colloidal Pd/Sn activator on a chloride base. The palladium concentration in the activator was 100 mg/l. The thus-activated substrate was then treated in a conductor solution comprising 65 g/l of tartaric acid, 50 g/l potassium hydroxide and 8 g/l copper (II) sulfate treatment for 5 minutes. Subsequently, the circuit board panel was copper plated in an electroless copper electrolyte at 45° C. for 20 minutes. Thereafter, a further galvanic reinforcement could take place in a copper sulfate electrolyte at 2 A/dm$^2$ to a thickness of 25 microns in the borehole-center.

By adding 5 g/l sodium hypophosphite and 1 g/l sodium-hydroxyl-methyl-sulfonate to the conductor solution, electroless copper plating could be dispensed under otherwise identical conditions of the activator and conductor and instead a direct galvanic metallization could take place in the copper sulfate electrolyte to the desired layer thickness.

TABLE 2

| | Experiment | |
|---|---|---|
| | F | G |
| Complexing Agent | Tartaric acid (65 g/liter) | Tartaric acid 65 g/liter |
| Na hydroxymethane Sulfonate | — | 5 g/liter |
| Cu in mg/m$^2$ | 35 | 1700 |
| Surface resistance in 5 cm | 15,000 Ω | 3000 Ω |

Example 4

An ABS plastic substrate called Novodur P2MC was treated under the conditions described in Example 1, each with an activator and conductor solution. In this case, 10 g/l of sodium hypophosphite was added to the conductor solution as a reducing agent.

To assess the effect of exposure time in the conductor solution, a variation of the treatment time from 2 to 32 minutes occurred. The metal concentrations deposited on the substrate surface are shown in Table 3.

TABLE 3

| | Exposure time in the conductor solution in min. | | | | |
|---|---|---|---|---|---|
| | 2 | 4 | 8 | 16 | 32 |
| Cu in mg/m$^2$ | 870 | 1400 | 1700 | 1700 | 1700 |
| Pd in mg/m$^2$ | 43 | 43 | 44 | 43 | 40 |

Table 2 shows clearly that with an exposure time in the conductor solution of more than 8 minutes, no further deposition of copper on the substrate surface occurs. This confirms the assumption that the present invention is a method for direct metallization and no arbitrary layer formation can occur in the conductor solution, which is the case with an electroless copper electrolyte plating.

What is claimed is:

1. A method for direct metallization of a non-conductive substrate, comprising:

contacting the substrate with an aqueous metal-containing activator formulation comprising a noble metal/metal-colloid, said noble metal/metal-colloid comprising a colloidal noble metal selected from the group consisting of gold, silver, platinum and palladium and oxidizable ions of a metal selected from the group consisting of iron, tin, lead, cobalt, and germanium, thereby depositing colloidal noble metal on the substrate and activating the substrate for deposition of another metal;

contacting the activated substrate with a conductor solution having a free alkalinity between 0.5 and 2 moles/liter, and comprising:

an ion of said another metal that is reducible by a metal ion of the activator formulation;

a complexing agent, at least one Group IA or Group II metal ion selected from the group consisting of lithium, sodium, potassium, rubidium, cesium and beryllium, a counteranion selected from the group consisting of fluoride, chloride, bromide, iodide, nitrate, sulfate and combinations thereof;

and a reducing agent other than formaldehyde, wherein said reducing agent is selected from the group consisting of a hypophosphite, an aminoborane, an hydroxymethylsulfonate, an hydroxylammonium sulfate, a bisulfite and a thiosulfate, and, the ratio of the sum of the molar concentration(s) of said counteranion(s) to the sum the molar concentration(s) of all reducing agents for said reducible metal ion in said conductor solution at the time of initial contact with said activated substrate is between about 0.70 and about 50, and the ratio of the total concentration of reducible metal ions to nickel ions is at least about 10;

reducing said reducible metal ion by reaction with said oxidizable metal ion and by reaction with said reducing agent as catalyzed by said noble metal, thereby depositing a conductive layer comprising said another metal on said substrate wherein no further reduction and deposition of the reducible metal ions can occur at any location on the substrate where the reducible metal has already been deposited, wherein an accelerator solution is not used prior to contact with the conductor solution; and subsequent to depositing said conductive layer, electrolessly and/or electrolytically plating said another metal onto the substrate.

2. The method as set forth in claim 1 wherein the ratio of the sum of the molar concentration(s) of said counteranion(s) to the sum the molar concentration(s) of said Group IA and Group II metal ions in said conductor solution at the time of initial contact with said activated substrate is at least about 0.2.

3. The method as set forth in claim 1 wherein the conductor solution contains nickel ions and the molar ratio of the total concentration of reducible metal ions to nickel ions is at least about 1000.

4. The method as set forth in claim 1 wherein the ratio of the sum of the molar concentrations of said counteranion(s) to the sum the molar concentration(s) of said reducible metal ions in said conductor solution at the time of initial contact with said activated substrate is at least about 5.

5. The method as set forth in claim 4 wherein said ratio of the sum of the molar concentrations of said counteranion(s) to the sum the molar concentration(s) of said reducible metal ions in said conductor solution at the time of initial contact with said activated substrate is at least about 40.

6. The method as set forth in claim 5 wherein the ratio of the molar concentration of reducing agent to the molar concentration of reducible metal ions is at least about 1.0.

7. The method as set forth in claim 5, the preparation of said conductor solution having comprised dissolving a salt comprising said reducible metal ion, said complexing agent, said reducing agent and a lithium salt of said counteranion in an aqueous medium.

8. The method as set forth in claim 7, wherein the conductor solution comprises cupric ion, a complexing agent, and a plurality of reducing agents other than formaldehyde.

9. The method according to claim 1 wherein the another metal that is deposited on the substrate by reaction with an oxidizable metal ion of the activator formulation is deposited in a molar ratio to the noble metal of the activator of 5:1 to 400:1.

10. The method according to claim 1, wherein at least two different reducing agents are present in said conductor solution.

11. The method as set forth in claim 1 wherein the conductor solution comprises a reducing agent and complexing agent combination selected from the group consisting of the following:

(a) between about 0.1 and about 0.3 mol/l tartaric acid and between about 50 and about 200 mmoles/liter alkali metal hypophosphite;

(b) between about 0.1 and about 0.3 mol/l tartaric acid, between about 50 and about 200 mmol/l alkali metal hypophosphite and between 3 and about 60 mmol/l alkali metal hydroxylmethylsulfonate;

(c) between about 0.1 and about 0.3 mol/l glycolic acid and between about 50 and about 200 mmol/l alkali metal hypophosphite;

(d) between about 20 and about 200 g/l tartaric acid, between about 1 g/l and about 50 g/l alkali metal hypophosphite, and between about 0.5 and about 20 g/l alkali metal hydroxylmethyl sulfonate; and (e) between about 0.1 and about 0.3 mol/l tartaric acid (0.2 mol/l) and between about 2 and about 50 g/l alkali metal hypophosphite.

12. The method as set forth in claim 1 wherein the substrate is selected from the group consisting of acrylonitrile-butadiene-styrene and blends of acrylonitrile-butadiene-styrene with other plastics.

13. The method of claim 1 wherein the conductor solution comprises:

lithium ions from lithium chloride and sodium ions from sodium hydroxide as the at least one Group IA or Group II metal ion;

Cu ion from $CuSO_4$ as the ion of said another metal that is reducible by said metal ion of the activator formulation;

at least one compound from the group consisting of hypophosphites, aminoboranes, hydroxymethylsulfonates, hydroxylammonium sulfates, bisulfites and thiosulfates as the reducing agent in a concentration between 0.006 mol/1 and 0.170 mol/l; and wherein the complexing agent comprises tartaric acid in a concentration between 0.1 mmol/l and 1.0 mol/l for complexing the Cu ion.

14. A process as set forth in claim 1 wherein said conductive layer comprises copper in a surface density of at least about 500 $mg/m^2$.

15. A process as set forth in claim 1 wherein the surface resistance of said conductive layer is not greater than 2000Ω over a 5 cm distance.

16. The method according to claim 1, wherein said conductor solution is free of any electroless plating promoter comprising an oxy anion other than absorbed quantities of carbonate or bicarbonate in a sum of not greater than 1% by weight.

* * * * *